US011933504B2

(12) United States Patent
Leezer

(10) Patent No.: US 11,933,504 B2
(45) Date of Patent: Mar. 19, 2024

(54) MAKEUP AIR PACKAGED TERMINAL AIR CONDITIONING UNIT

(71) Applicant: Midea Group Co., Ltd., Foshan (CN)

(72) Inventor: David Leezer, LaGrange, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 225 days.

(21) Appl. No.: 17/359,439

(22) Filed: Jun. 25, 2021

(65) Prior Publication Data

US 2022/0412576 A1 Dec. 29, 2022

(51) Int. Cl.

| | |
|---|---|
| ***F24F 1/027*** | (2019.01) |
| ***F24F 11/72*** | (2018.01) |
| ***F24F 11/81*** | (2018.01) |
| ***F24F 13/20*** | (2006.01) |
| ***F24F 13/28*** | (2006.01) |
| ***F24F 120/10*** | (2018.01) |

(52) U.S. Cl.

CPC ..... *F24F 1/027* (2013.01); *F24F 11/72* (2018.01); *F24F 11/81* (2018.01); *F24F 13/20* (2013.01); *F24F 13/28* (2013.01); *F24F 2120/10* (2018.01)

(58) Field of Classification Search

CPC ..... F24F 1/027; F24F 11/81; F24F 1/0035; F24F 2011/0002

See application file for complete search history.

(56) References Cited

U.S. PATENT DOCUMENTS

| | | | | |
|---|---|---|---|---|
| 3,693,704 | A | 9/1972 | Newton | |
| 4,084,389 | A | 4/1978 | Meckler | |
| 4,524,588 | A | 6/1985 | Bond | |
| 4,553,405 | A | 11/1985 | Napolitano et al. | |
| 4,667,580 | A | 5/1987 | Wetzel | |
| 5,305,822 | A | 4/1994 | Kogetsu et al. | |
| 5,372,189 | A | 12/1994 | Tsunekawa et al. | |
| 5,884,500 | A | 3/1999 | Wetzel | |
| 6,151,906 | A | 11/2000 | da Silva | |
| 6,182,460 | B1 | 2/2001 | Hernandez et al. | |
| 6,276,156 | B1 | 8/2001 | da Silva et al. | |
| 6,349,555 | B1 | 3/2002 | Barros et al. | |
| 6,363,735 | B1 | 4/2002 | Bushnell et al. | |
| 7,251,953 | B2 | 8/2007 | Wetzel et al. | |
| 7,628,026 | B1 | 12/2009 | Kritsky et al. | |
| 10,365,008 | B2 | 7/2019 | Yokota et al. | |
| 10,436,457 | B2 | 10/2019 | Eicher et al. | |
| 10,520,213 | B2 | 12/2019 | D'Souza et al. | |
| 10,655,867 | B2 | 5/2020 | Jewell et al. | |
| 2008/0156891 | A1* | 7/2008 | Zhou | F24F 3/1405 236/47 |
| 2016/0348926 | A1* | 12/2016 | Bailey | F24F 1/027 |
| 2018/0231266 | A1* | 8/2018 | Fradkin | F24F 11/30 |
| 2018/0347835 | A1* | 12/2018 | Chapin | F24F 1/027 |
| 2019/0271478 | A1 | 9/2019 | Henderson et al. | |

FOREIGN PATENT DOCUMENTS

| | | | |
|---|---|---|---|
| GB | 2374921 | A | 10/2002 |
| WO | WO2005019737 | A2 | 3/2005 |

* cited by examiner

*Primary Examiner* — Schyler S Sanks

(74) *Attorney, Agent, or Firm* — Gray Ice Higdon

(57) ABSTRACT

An air conditioning unit is disclosed. The air conditioning unit may include a makeup air system having a makeup air duct with a first end and a second end. The makeup air duct may be separate structure built in a bottom plate of the air conditioning unit and define an air flow passage in fluid communication between the first end and the second end to allow makeup air to flow therethrough.

19 Claims, 5 Drawing Sheets

MAKEUP AIR PACKAGED TERMINAL AIR CONDITIONING UNIT

BACKGROUND

As buildings nowadays are better sealed to improve energy efficiency, poor indoor air quality may cause occupants health issues due to a lack of fresh air exchanges. States and agencies have adopted related codes and regulations requiring a certain amount of fresh outdoor air, which is commonly referred to as makeup air, to be provided to the indoor space, and packaged terminal air conditioning (PTAC) units are often used for this purpose. Most traditional PTAC units include a partition (also known as a "bulkhead") positioned between an indoor portion and an outdoor portion, thus generally separating the unit components within the indoor portion from the components within the outdoor portion. Common PTAC units allow makeup air to flow from the outdoor portion into the indoor portion through an opening (also known as a "vent aperture") in the bulkhead for makeup air flowing through into a conditioned room. Also, a vent door is usually provided for the vent aperture in the bulkhead to open and close the makeup air flow passage.

During operation of a traditional PTAC unit, when makeup air is desired, the vent door in the bulkhead is opened, and a path is provided for makeup air moving by a suction force created by an indoor fan. Then, makeup air mixed with room return air may be blown into a conditioned room through an air outlet in the front of the PTAC unit. With such a configuration, however, the makeup air flow rate is usually substantially below the requirement of current codes and regulations. Further, because the flow of makeup air through the vent aperture in the bulkhead is drawn by a relatively slight negative pressure created by the indoor fan, the flow rate may be substantially influenced by other factors such as an outdoor fan or by an interior room side static pressure. More specifically, if the outdoor fan located in the outdoor portion is running at the same time that the vent door is open, some of fresh air in the outdoor portion, which would otherwise be drawn through the bulkhead as makeup air, may be drawn by the outdoor fan to flow through an outdoor heat exchanger to the outside.

Therefore, there remains a need in the art to improve the makeup air ventilation capacity of existing PTAC units.

SUMMARY

The present disclosure is directed to an apparatus of an air conditioning unit with a makeup air system for providing makeup air to a conditioned room, and more particularly to an air conditioning unit with a separate makeup air duct structure built in a bottom plate, extending from an outdoor portion to an indoor portion of the unit as an independent makeup air flow passage, and a unique indoor heat exchanger design, where a portion of the indoor heat exchanger may switch between a condenser and an evaporator depending on the operation mode of the unit.

In some embodiments, an air conditioning unit may include an outdoor heat exchanger disposed in an outdoor portion, an indoor heat exchanger disposed in an indoor portion, and a partition plate disposed between the outdoor heat exchanger and the indoor heat exchanger along a transverse direction. The partition plate may define the indoor portion and the outdoor portion. The air conditioning unit may further include a bottom plate that components of the air conditioning unit are disposed thereon and a makeup air system having a makeup air duct with a first end and a second end. The makeup air duct may define an air flow passage in fluid communication between the first end and the second end to allow makeup air to flow therethrough. The makeup air duct may be a separate structure built in the bottom plate.

In some embodiments, a makeup air system for an air conditioning unit may include a bottom plate accommodating components of the air conditioning unit and a partition plate defining an outdoor portion and an indoor portion. The makeup air system may further include a makeup air duct with a first end and a second end and a makeup air fan located in the makeup air duct. The makeup air duct may define an air flow passage in fluid communication between the first end and the second end to allow makeup air to flow therethrough. The makeup air duct may be a separate structure built in the bottom plate.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above-outlined features are to be understood as exemplary only, and many more features and objectives of the various embodiments may be gleaned from the disclosure herein. Therefore, no limiting interpretation of this summary is to be understood without further review of the entire specification, claims, and drawings included herewith. A more extensive presentation of features, details, utilities, and advantages of the present disclosure is provided in the following written description of various embodiments of the disclosure, illustrated in the accompanying drawings, and defined in the appended claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosure

DETAILED DESCRIPTION

Figure 1:
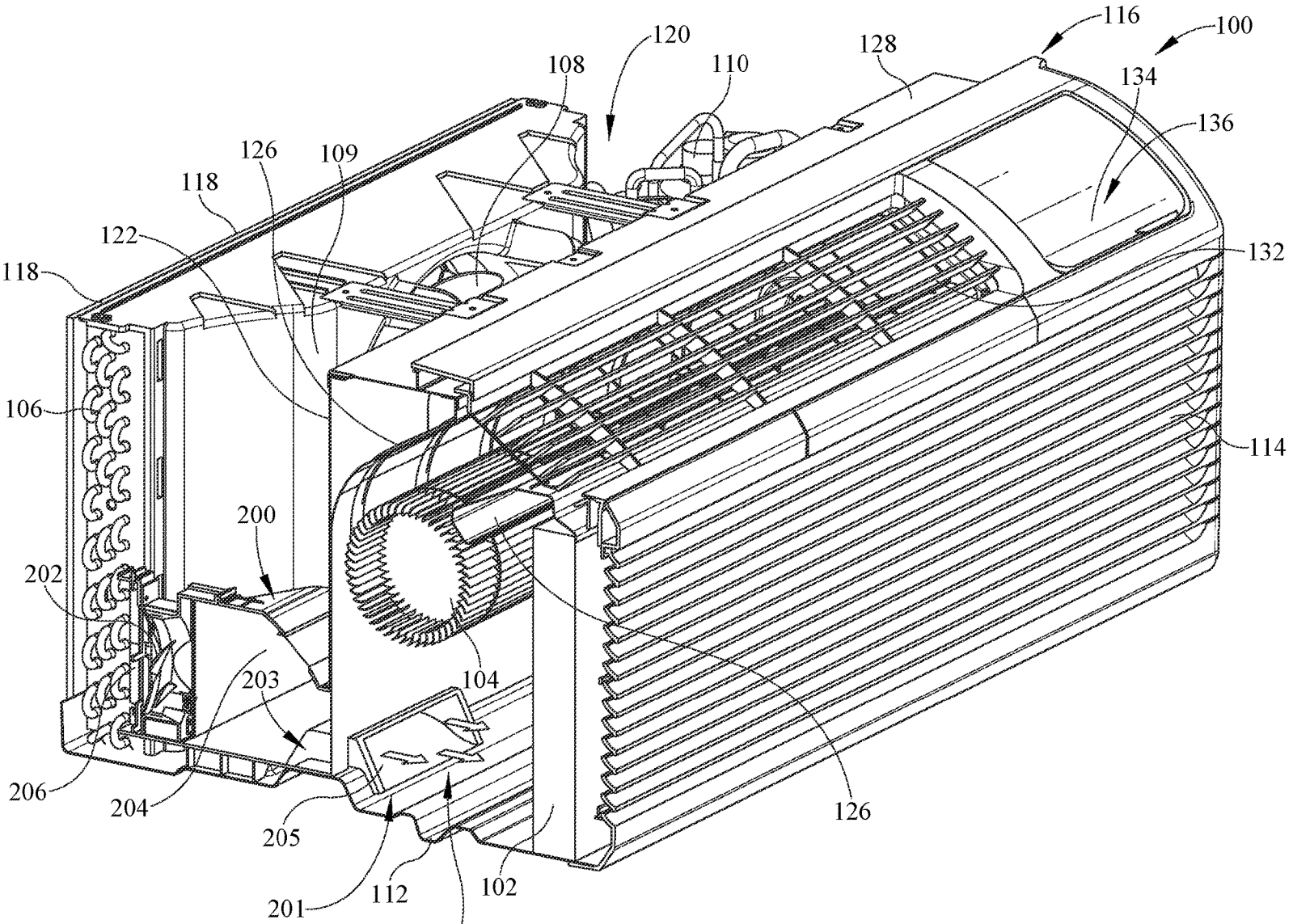
FIG. 1 is a perspective view of an air conditioning unit with one side cutaway, according to an embodiment of the present disclosure.

It is to be understood that an air conditioning unit with a makeup air system is not limited in its application to the details of construction and the arrangement of components set forth in the following description or illustrated in the drawings. The described embodiments are capable of other configurations and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof, as well as additional items. Unless limited otherwise, the terms "connected," "coupled," and "mounted," and variations thereof, are used broadly and encompass direct and indirect connections, couplings, and mountings. In addition, the terms "connected" and "coupled" and variations thereof are not restricted to direct physical or mechanical connections or couplings. The elements depicted in the accompanying figures may include additional components and that some of the components described in those figures may be removed and/or modified without departing from scopes of the elements disclosed herein. The elements depicted in the figures may not be drawn to scale and thus, the elements may have different sizes and/or configurations other than as shown in the figures.

Turning now to the drawings, wherein like numbers denote like parts throughout the several views, an air conditioning unit with a makeup air system 100, in accordance with various embodiments, will be described with reference to the accompanying drawings. The air conditioning unit 100 as shown in FIG. 1 may include an indoor heat exchanger 102, an indoor fan 104, an outdoor heat exchanger 106, an outdoor fan 108, and a compressor 110. The air conditioning unit 100 may be an integral-type air conditioning unit, also conventionally referred to as a package terminal air conditioning (PTAC) unit, which is set up to penetrate through a wall of a building (not shown).

In different embodiments, the indoor heat exchanger 102 and the outdoor heat exchanger 106 may be any suitable number, type, and configuration of heat exchanger configurable to operate as an evaporator and/or a condenser, and in particular, may be a suitable indirect heat exchanger such as a microchannel heat exchanger. In some embodiments, as shown in FIG. 1, the indoor fan 104 may be a centrifugal fan, such as a cross-flow fan with wheels rotated by an indoor fan driving motor, and the outdoor fan 108 may be an axial fan, such as a propeller fan rotated by an outdoor fan driving motor. However, it should be understood that the indoor fan 104 and the outdoor fan 108 may be any other suitable number, type, and configuration of fan configurable to drive air flows. In addition, in some embodiments, the indoor fan 104 and the outdoor fan 108 may be a variable speed fan. In different embodiments, the compressor 110 may be any suitable number, type, and configuration of compressor suitable for air conditioning units (e.g., a integrally fabricated compressor) operable to compress refrigerant. In some embodiments, the compressor 110 may be a variable speed compressor (e.g., an inverter compressor), which may improve efficiency during certain operation mode (e.g., a low speed dehumidification mode).

The components mentioned above (e.g., the indoor heat exchanger 102, the indoor fan 104, etc.) may be disposed on a bottom plate 112 to constitute a main body of the air conditioning unit 100. To hinder or limit access to the components of the main body, the indoor side of the main body (that is, the portion contains the indoor heat exchanger 102 and the indoor fan 104) may be covered by a front panel 114, and the outside side thereof (that is, the portion contains the outdoor heat exchanger 106, the outdoor fan 108, and the compressor 110) may be covered by a back panel 118. The front panel 114 may be positioned to face the inside of a conditioned room, and the back panel 118 may be set up in a wall of the conditioned room with the air conditioning unit 100 penetrating through the wall of the conditioned room. The front panel 114 and the back panel 118 each define a plurality of openings that permit air to flow through the front panel 114 and the back panel 118, respectively, with the openings sized for preventing foreign objects from passing through the front panel 114 and the back panel 118 into air conditioning unit 100. Accordingly, the front panel 114 and the back panel 118 may communicate with the inside and outside of the conditioned room, respectively, so that room return air and makeup air may be drawn in by the indoor fan 104 and the outdoor fan 108, respectively.

As shown in FIG. 1, a partition plate 122 may be provided between the front side and the back side of the bottom plate 112 in a manner to extend in a full-width direction of the bottom plate 112. The partition plate 122 may separate the inside space of the air conditioning unit 100 into an indoor portion 116, in which the indoor heat exchanger 102, the indoor fan 104, etc. are arranged, and an outdoor portion 120, in which the outdoor heat exchanger 106, the outdoor fan 108, the compressor 110, etc. are arranged. Accordingly, the front panel 114 disposed at the front side of the air conditioning unit 100 covers the indoor portion 116, and the back panel 118 disposed at the back side of the air conditioning unit 100 covers the outdoor portion 120. The partition plate 122 may function as a barrier to prevent noise and excessive unconditioned air from entering the indoor portion 116. In some embodiments, as shown in FIG. 1, the partition plate 122 may be modified to be of a certain shape and/or configuration (e.g., the bottom of the partition plate 122 may not touch the upper surface of the bottom plate 112) to accommodate refrigerant piping, electrical wires, or other components, such as a makeup air system 200 as described in detail below, running between the indoor portion 116 and the outdoor portion 120 thereunderneath, without compromising the integrity of the partition plate 122.

Figure 1A:
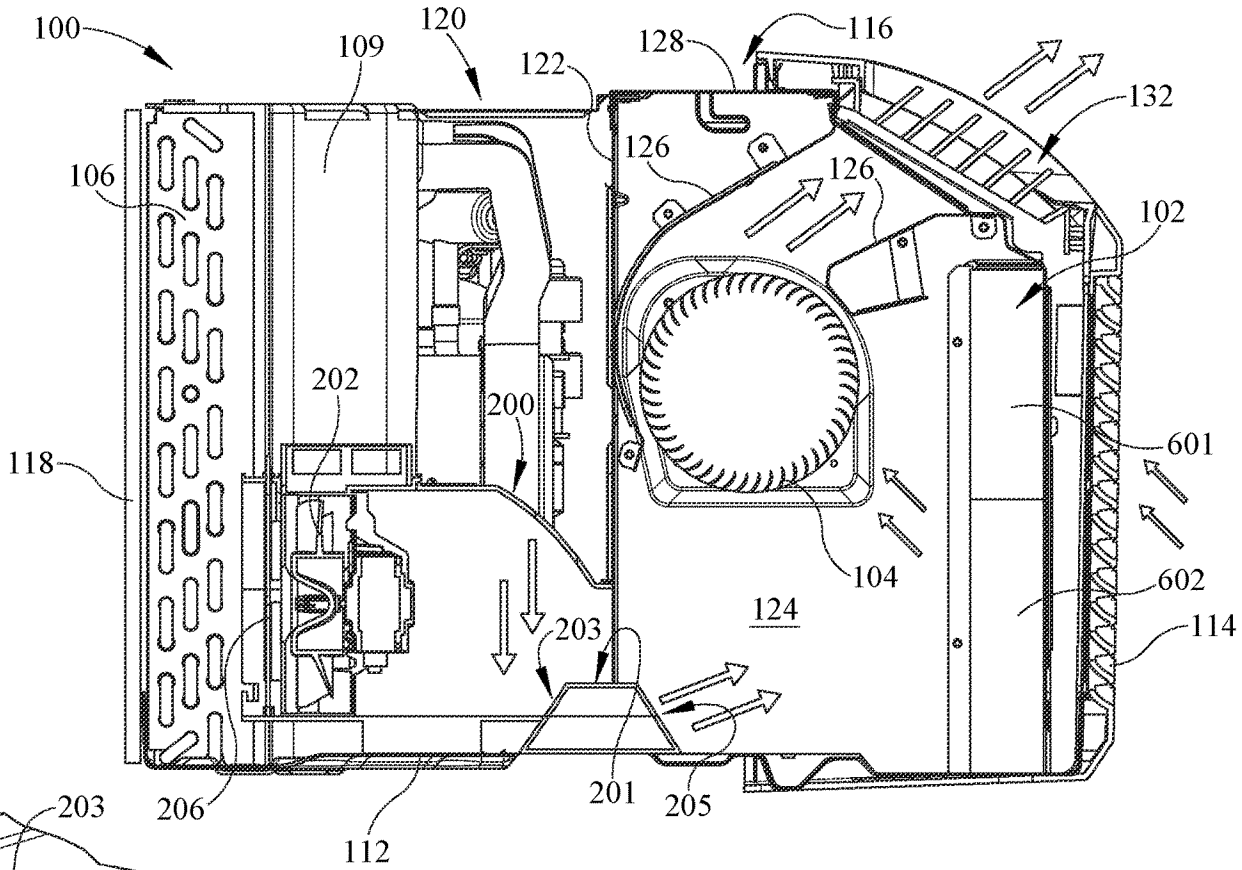
FIG. 1A is a side cutaway view of the air conditioning unit of FIG. 1.

In some embodiments, a diffuser 132 for guiding the air into the conditioned room may be provided at the top of the front panel 114 of the air conditioning unit 100 as shown in FIG. 1. In some embodiments, one or more air filters may be disposed adjacent the diffuser 132 and the front panel 114 respectively. In some embodiments, one or more indoor fan casings 126 may be disposed adjacent the partition plate 122 in the indoor portion 116 and curved from a top panel 128 to extend toward the bottom plate 112. As shown in FIGS. 1 and 1A, one indoor fan casing 126 may be disposed between the partition plate 122 and the indoor fan 104, and the other indoor fan casing 126 may be disposed between the front panel 114 and the diffuser 132. Therefore, in some embodiments, one or more indoor fan casings 126 together may serve as an indoor circulating plenum 124 to allow makeup air to fully mix with the room return air. Meanwhile, the indoor fan casing 126 may also work as a heat shield to prevent heat transfer between conditioned air and unconditioned air for better energy efficiency. For similar purposes, in some embodiments, an outdoor fan casing 109 may be disposed to be connected to the outdoor heat exchanger 106, and the outdoor fan 108 may be disposed inside the outdoor fan casing 109.

As known in the art, under the heat pump cooling operation of the air conditioning unit 100, the outdoor heat exchanger 106 functions as a condenser and discharges heat to the outside air, and the indoor heat exchanger 102 functions as an evaporator and takes heat to cool the air for cooling the conditioned room. Under the heat pump heating operation of the air conditioning unit 100, the outdoor heat exchanger 106 functions as an evaporator, and the indoor heat exchanger 102 functions as a condenser to heat the air for heating the conditioned room. In some embodiments, the air conditioning unit may also have a dehumidification operation mode. During the dehumidification operation mode, the outdoor heat exchanger 106 functions as a condenser, and the indoor heat exchanger 102 functions as a condenser (i.e., as a reheat coil) and an evaporator simultaneously. The heat exchange transfer between the outdoor heat exchanger 106 and the indoor heat exchanger 102 will be discussed in greater detail below.

To direct makeup airflow from the outdoor portion 120 to the indoor portion 116, the makeup air system 200 may include a makeup air duct 201, which defines a makeup air flow passage that is in fluid communication between the outdoor portion 120 and the indoor portion 116. In this manner, the flow of makeup air in the outdoor portion 120 may pass through the makeup air duct 201 into the indoor portion 116 then into the conditioned room. More specifically, the makeup air duct 201 may further define a first end 203 as a makeup air inlet and a second end 205 as a makeup air outlet spaced apart from each other along the flow direction of makeup air shown as arrows in FIG. 1A. In some embodiments, the first end 203 may be positioned at a location where the negative pressure generated by the outdoor fan 108 does not significantly affect the airflow of makeup air in the makeup air system 200. For example, the first end 203 of the makeup air duct 201 may extend away from the second end 205 toward the back panel 118 of the air conditioning unit 100. In some embodiments, the first end 203 may be positioned in the outdoor portion 120 and be adjacent the partition plate 122, with the second end 205 positioned in the indoor portion 116.

Figure 1B:
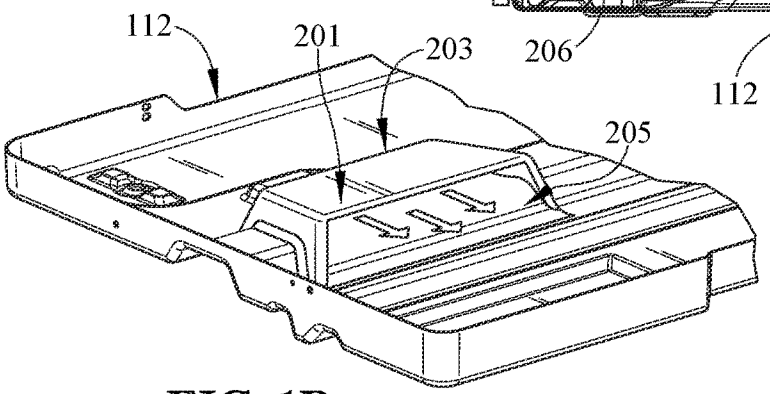
FIG. 1B is a perspective view of a section of a bottom plate of the air conditioning unit of FIG. 1.
Figure 2:
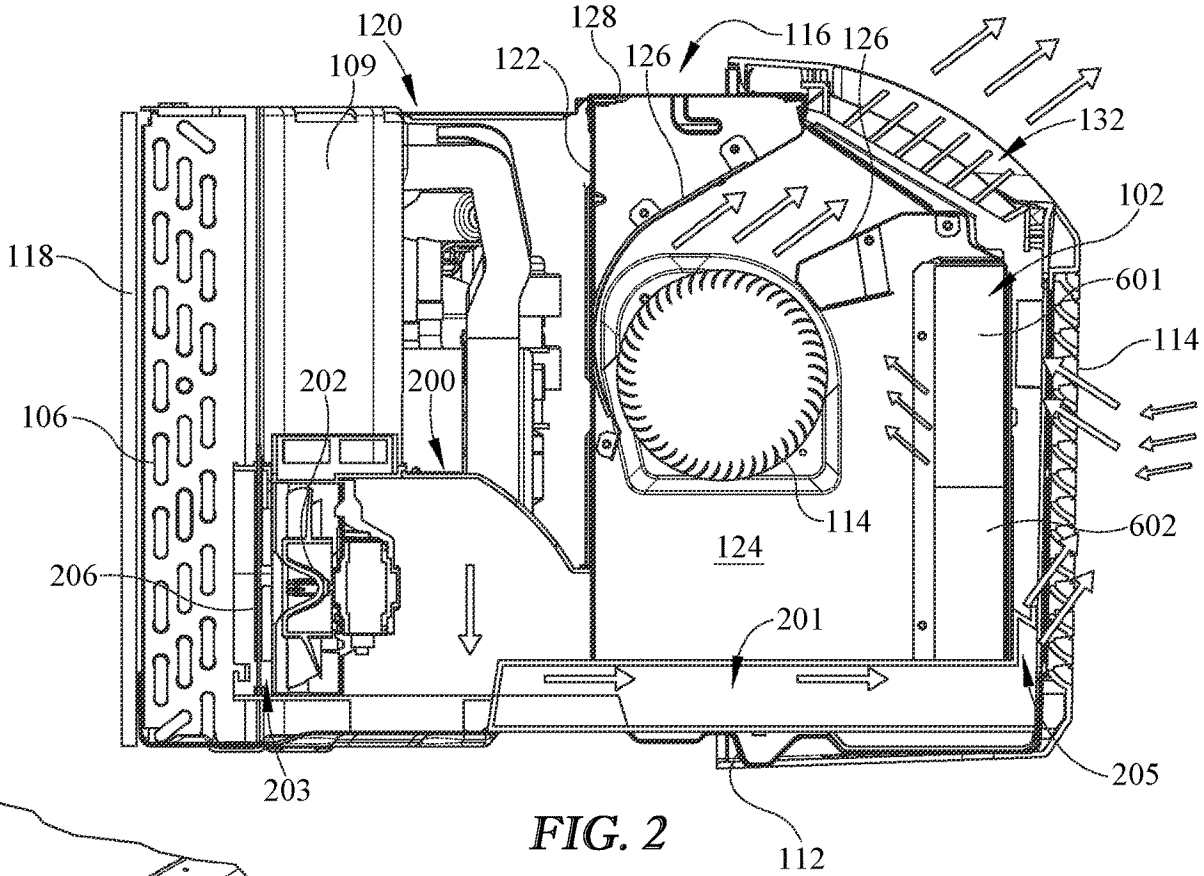
FIG. 2 is a side cutaway view of an air conditioning unit, according to another embodiment of the present disclosure.
Figure 2A:
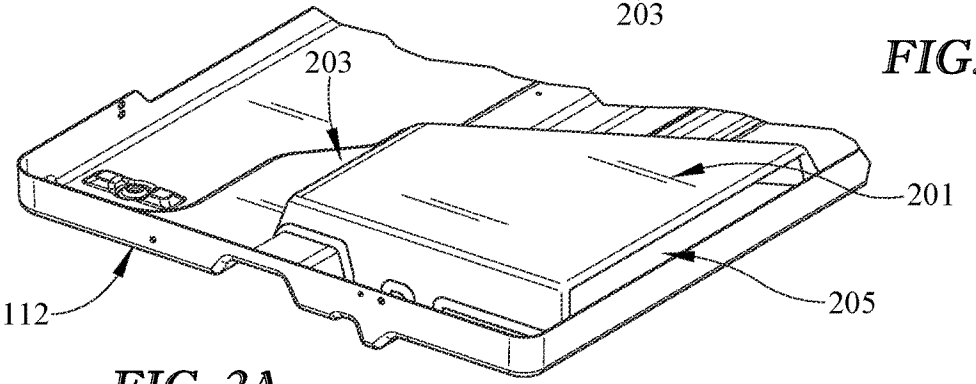
FIG. 2A is a perspective view of a section of a bottom plate of the air conditioning unit of FIG. 2.

For example, in some embodiments as shown here, the makeup air duct 201 may be built in the bottom plate 112 and underneath the partition plate 122. In different embodiments, the second end 205 may be positioned at different locations as the makeup air outlet. For example, in some embodiments, as shown in FIGS. 2 and 2A, the second end 205 may be positioned proximate the front panel 114, which is also the air inlet of the indoor heat exchanger 102. In this manner, the makeup air is directed to the conditioned room directly through the front panel 114 without mixing with the room return air. In some other embodiments, as shown in FIGS. 1, 1A, and 1B, the makeup air duct 201 may be shorten in length. With the second end 205 adjacent the partition plate 122, the makeup air may exit at the location of the partition plate 122 into the outdoor portion 120 to mix with the room return air before entering the conditioned room. In some embodiments, the bottom plate 112 may be modified to accommodate the makeup air duct 201 therein.

During operation of the air conditioning unit 100, fresh air may be extracted from the outside into the outdoor portion 120 by the outdoor fan 108 and/or the makeup air fan 202. Part of the fresh air may be blown through the outdoor heat exchanger 106 for heat transfer and then exhausted to the outside through the back panel 118, and part of the fresh air may be drawn into the makeup air system 200 as makeup air. Meanwhile, air in the conditioned room may be drawn through the front panel 114 into the indoor portion 116 by the indoor fan 104, so the room return air may pass through the indoor heat exchanger 102 for heating or cooling. Then, depending on the locations of the second end 205 of the makeup air duct 201, the makeup air may be directed into the conditioned room directly, or the makeup air may mix with the conditioned room return air in the indoor circulating plenum 124 first before entering the conditioned room. Thereafter, the conditioned air may be expelled from the diffuser 132 at the top of the air conditioning unit 100 into the room by the rotation of the indoor fan 104 to air condition the room as desired.

As described above, the makeup air duct 201 of the makeup air system 200 may be built in the bottom plate 112 of the air conditioning unit 100. It should be understood that the makeup air duct 201 of the makeup air system 200 may be built in the bottom plate 112 at any feasible location. The makeup air duct 201 may be made from any feasible material in the industry, such as plastic, metal, etc. It should be understood that the makeup air duct 201 may be formed by injection molding, e.g., using a suitable plastic material, such as injection molding grade high impact polystyrene or acrylonitrile butadiene styrene. In some embodiments, the makeup air duct 201 may be compression molded, e.g., using sheet molding compound thermoset plastic. In some embodiments, the makeup air duct 201 may include multiple portions that are separately formed, e.g., via compression molding, and are subsequently joined to form the makeup air duct 201. It should be understood that variations and modifications to the makeup air duct 201 may be acceptable while remaining within scope of the present disclosure.

In some embodiments, the makeup air system 200 may also include a makeup air fan 202 for supplementing the indoor fan 104 of the air conditioning unit 100 to effectively move makeup air. For example, as shown in FIGS. 1, 1A, and 2, a makeup air fan 202 may be located proximate the back panel 118 along the flow direction of makeup air in the outdoor portion 120 and may operate to urge the flow of makeup air into the indoor potion 116 (as indicated by arrows). Alternatively, the makeup air fan 202 may be disposed downstream along the flow direction of makeup air and may operate to draw the flow of makeup air into the indoor potion 116. It should be understood that the makeup fan 202 may be positioned at any suitable locations in fluid communication with the makeup air duct 201, and the embodiments described herein are only exemplary and are not intended to limit the scope present disclosure.

As shown in FIGS. 1, 1A, and 2, the makeup air fan 202 may be an axial fan. However, it should be understood that any other suitable number, type, and configuration of fan could be used to urge or draw a flow of makeup air according to alternative embodiments. Although the makeup air fan 202 is illustrated as being directly mounted within the indoor portion 116, it should be understood that according to alternative embodiments, the makeup air system 200 may instead include a fan mounting structure that is separately assembled and attached to the indoor portion 116. In this manner, the fan mounting structure may be separately installed into the indoor portion 116, and the makeup air fan 202 may be inserted into the indoor portion 116 and then installed onto the fan mounting structure. Other configurations and constructions are also possible and within the scope of the present disclosure. The related control strategy for the makeup air fan 202, such as the option of running the makeup air fan 202 on a schedule, or deactivate makeup air fan 202 based on room occupancy to reducing energy usage, will be discussed in greater detail below.

In some embodiments, the makeup air system may include a vent door 206 for opening or closing the makeup air flow passage. In some embodiments, the vent door 206 may be pivotally mounted in any suitable locations in the indoor portion 116 to open and close the makeup air flow passage of the makeup air duct 201. More specifically, the vent door 206 may be configured to pivot between a first, closed position where the vent door 206 prevents makeup air from flowing from the outdoor portion 120 into the indoor portion 116, and a second, open position where the vent door 206 allows makeup air to flow from the outdoor portion 120 into the indoor portion 116 then into the conditioned room. In some embodiments, the vent door 206 may be pivoted between the open and closed position by an electric motor controlled by a controller, or by any other suitable mechanism. It should be understood that the vent door 206 may be in any feasible configuration and operated in any feasible mechanisms. For example, the vent door 206 may be a sliding door and operated manually by a user. The related control strategy for the vent door 206, such as the option of controlling the vent door 206 to close off the makeup air duct 201 based on room occupancy to reduce energy usage, will be discussed in greater detail below.

In some embodiments, an air filter (not shown) may also be provided within the makeup air system 200 to improve indoor air quality if desired. For example, to meet the air quality requirements of some California building codes, a MERV 13 rated air filter may be installed through a filter groove (not shown). In such embodiments, due to the high resistance of the MERV 13 filter, an additional ventilation door (not shown) may be provided to allow enough makeup air to flow into the indoor portion 116. It should be understood that any other configuration for the vent door 206 and the additional ventilation door suitable to open and close the makeup air flow passage may be acceptable.

In summary, the makeup air system 200 including various components, such as the independent makeup air duct 201, the auxiliary makeup air fan 202, and so on, may operate to provide the appropriate amount of makeup air to meet the requirements of the related codes and regulations to maintain room occupants comfort and satisfaction at a maximum. Other advantages and benefits will be apparent to those having skill in the art.

Figure 3:
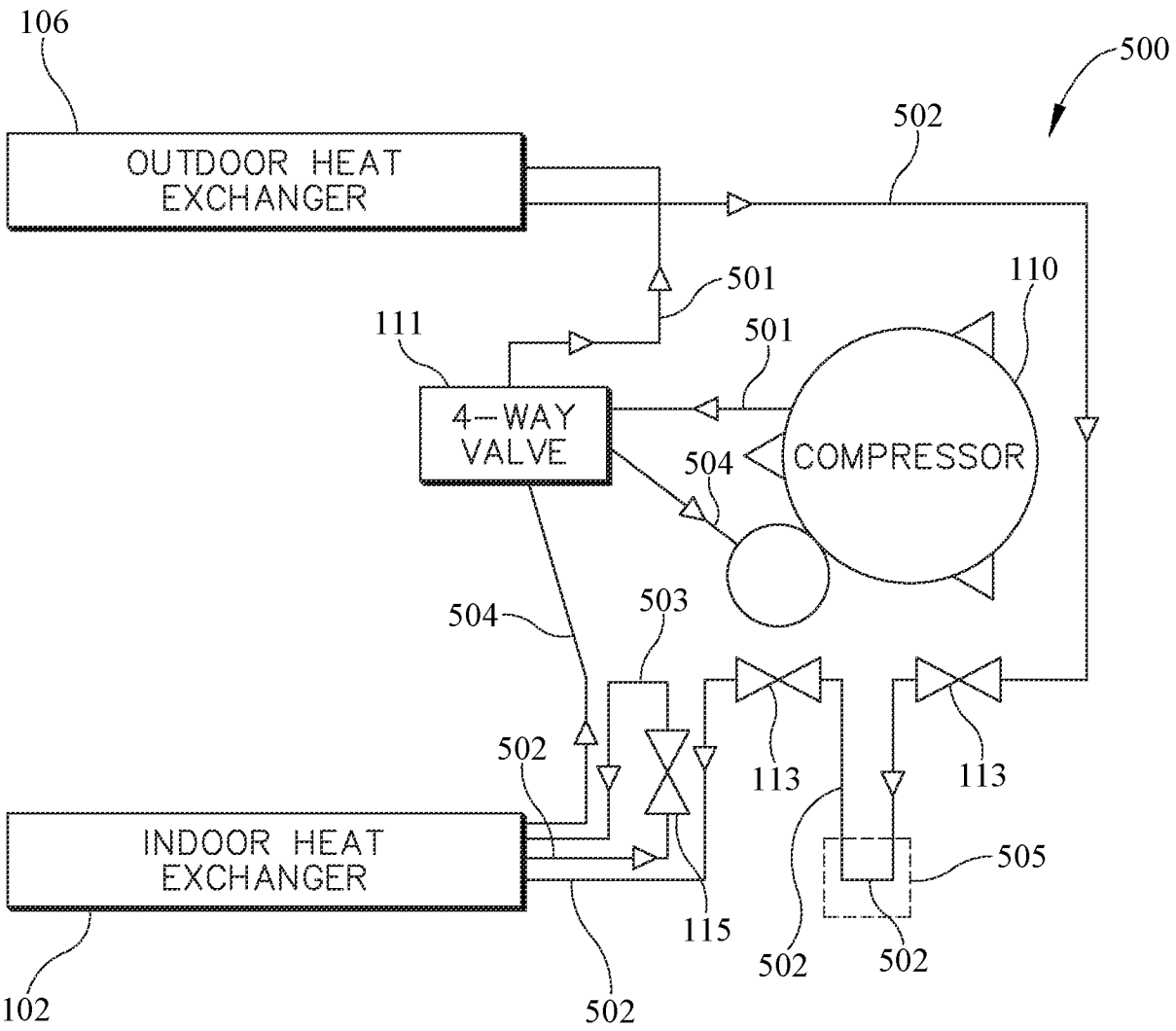
FIG. 3 is a refrigerant flow diagram of an air conditioning unit, according to an embodiment of the present disclosure.

As mentioned previously, in some embodiments, the indoor heat exchanger 102 may be modified to create a variable refrigerant flow path to allow a portion of the indoor heat exchanger 102 to switch between an evaporator and a condenser to work as a re-heat coil based on the operation mode of the air conditioning unit 100. As known in the art, the heating and/or cooling functions of the air conditioning unit 100 are achieved by operating a working fluid, commonly referred to as a refrigerant, through a thermodynamic cycle. More particularly, as shown in FIG. 3, a refrigeration loop 500 may include various paths for flowing refrigerant between the various components of the air conditioning unit 100, thus providing the fluid communication therebetween. Refrigerant may thus flow through such lines from the indoor heat exchanger 102 to the compressor 110, from the compressor 110 to the outdoor heat exchanger 106, from the outdoor heat exchanger 106 to one or more pressure reducing devices, such as expansion devices 113, and from the expansion device 113 to the indoor heat exchanger 102. The refrigerant may generally undergo phase changes associated with the refrigeration cycle as it flows to and through these various components, as is generally known in the art.

Suitable refrigerants for use in the refrigeration loop 500 may include pentafluoroethane, difluoromethane, ora mixture such as R410a, although it should be understood that the present disclosure is not limited to such example and rather that any suitable refrigerant may be utilized. The expansion device 113 may generally expand the refrigerant, lowering the pressure and temperature thereof. In some embodiments, the expansion device 113 may be disposed in the outdoor portion between the indoor heat exchanger 102 and the outdoor heat exchanger 106. In some embodiments, the expansion device 113 may be an electronic expansion valve that enables controlled expansion of refrigerant, as is known in the art. In alternative embodiments, the expansion device 113 may be a capillary tube or any other suitable expansion device configured for use in thermodynamic cycles for air conditioning units.

For example, as shown in FIG. 3, under the cooling operation of the air conditioning unit 100, the refrigerant leaves the compressor 110 as a vapor refrigerant at an elevated pressure and a high temperature in a first refrigerant line 501, and then flows into the outdoor heat exchanger 106 through a four-way valve 111 and condenses in the outdoor heat exchanger 106, resulting in a transfer of heat to the outdoor heat exchanger 106. The transfer of heat is removed to the outside fresh air by using the outdoor fan 108 to blow outside fresh air across the tubes and fins of the outdoor heat exchanger 106 to exit to the outside through the back panel 118. The high pressure and high temperature sub-cooled refrigerant liquid from the outdoor heat exchanger 106 may flow to a second refrigerant line 502 through the expansion device 113, such as an electrical expansion valve, where some of the refrigerant liquid flashes into vapor. In some embodiments as discussed in greater detail below, the air conditioning unit 100 may include an inverter compressor 110 and/or an inverter. In such embodiments, the remaining low pressure and low temperature refrigerant two-phase vapor and fluid in the second refrigerant line 502 may pass through an inverter heat sink 505 to cool the inverter. Then, the high pressure and high temperature refrigerant may flow through another expansion device 113 to decrease the pressure and the temperature increased by the inverter heat sink 505, and flow to the indoor heat exchanger 102 through the second refrigerant line 502, where the refrigerant vaporizes as a result of the relatively low pressure therein. The heat to support the vaporization is transferred from the air that is directed through the indoor heat exchanger 102 by the indoor fan 104. The closed loop is completed by a fourth refrigerant line 504 that connects the indoor heat exchanger 102 to the compressor 110 through a four-way valve 111. The low pressure and low temperature super-heated refrigerant vapor may be compressed by the compressor 110 into the vapor refrigerant at an elevated pressure and a high temperature in the first refrigerant line 501 as indicated previously.

It should be understood that the refrigerant loop 500 as described above may be made to function as a heat mode by reversing the direction of flow of the refrigerant so that the functions of the indoor heat exchanger 102 and the outdoor heat exchanger 106 are reversed. Accordingly, warm air may be blown into the room through the diffuser 132 and the cooler air would be exhausted to the outside through the back panel 118.

Figure 4:
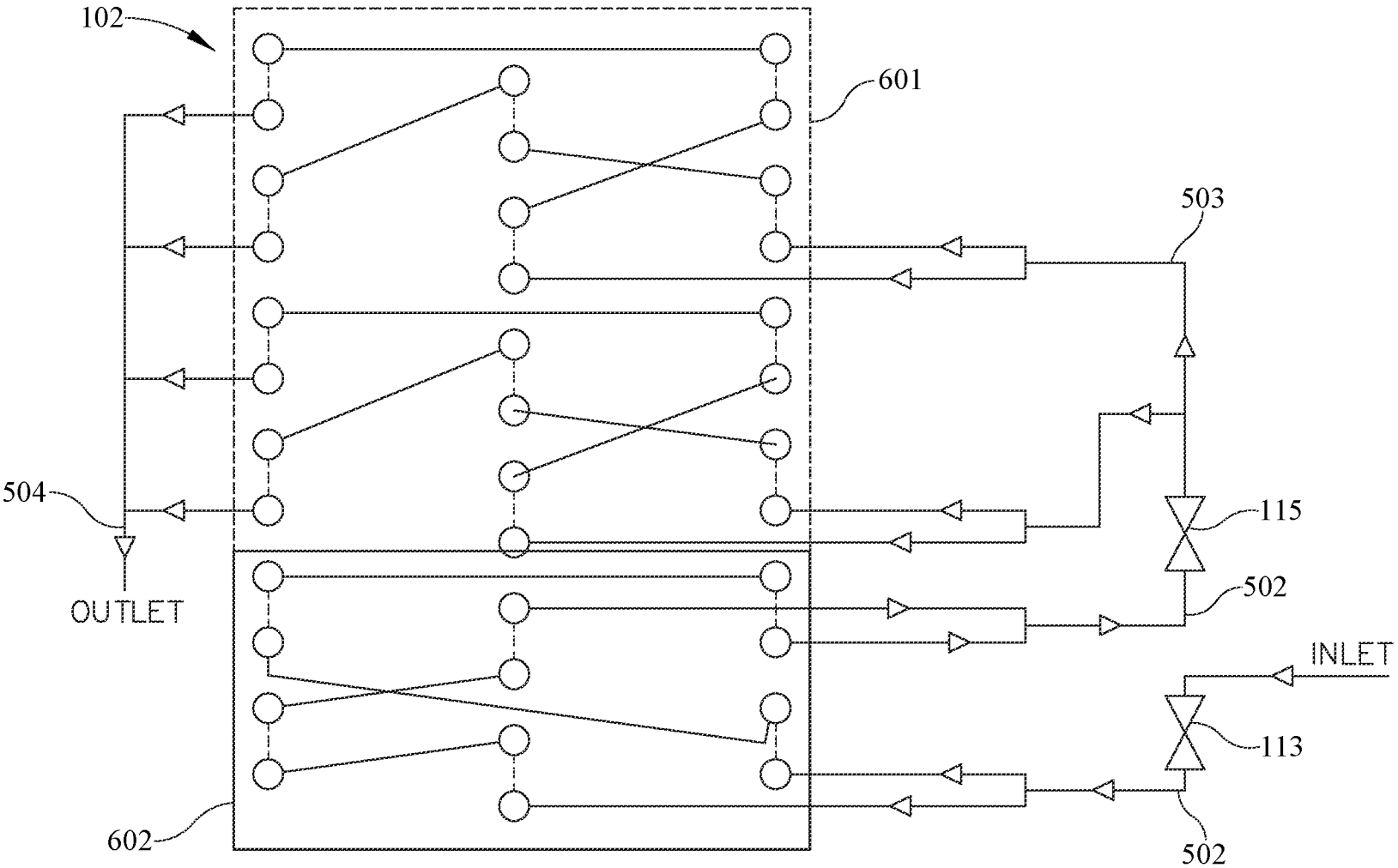
FIG. 4 is a detailed refrigerant flow diagram of a convertible indoor heat exchanger of an air conditioning unit, according to an embodiment of the present disclosure.

In some embodiments, besides the traditional heat pump cooling and heating modes, the air condition unit 100 may further include a dehumidification mode. The dehumidification operation of the air conditioning unit 100 is similar to the cooling operation, except that the indoor heat exchanger 102 includes features for switching a portion therein between cooling and re-heating in a cost-effective manner. Thus, the air conditioning unit 100 may not require an extra reheat coil, which adds cost and restricts airflow as in existing units. As known for the dehumidification operation, a temperature decrease below the air dew point may cause moisture condensation from the air, and such condensation removes moisture from the air to achieve the dehumidification. As the air after condensation may be relatively cooler and dryer, a variable portion 602 of the indoor heat exchanger 102 may work as a condenser to re-heat the air to make the temperature more comfortable. As shown in FIG. 4, a constant portion 601 of the indoor heat exchanger 102 may work as an evaporator configured for removing heat from the air flowing therethrough for dehumidification, while the variable portion 602 of the indoor heat exchanger 102 may work as a condenser configured for adding heat to the air flowing therethrough.

To make the variable portion 602 work as a condenser reheat coil while still keeping the constant portion 601 as an evaporator, the indoor heat exchanger 102 may further include a reheat expansion device 115 to expand the high temperature and high pressure refrigerant in a sub-cooled liquid condition in the second refrigerant line 502 to the low temperature and low pressure refrigerant in a two-phase mixture condition in a third refrigerant line 503, as shown in FIGS. 3 and 4. More specifically, the reheat expansion device 115 provided with the indoor heat exchanger 102 may be configured to precisely control the expansion of the refrigerant to maintain, for example, a desired temperature differential of the refrigerant across the indoor heat exchanger 102. In other words, the reheat expansion device 115 throttles the flow of refrigerant based on the reaction of the temperature differential across indoor heat exchanger 102 or the amount of superheat temperature differential, thereby ensuring that the refrigerant is in a low pressure and low temperate gaseous state before entering the compressor 110.

It should be understood that the refrigerant lines 501-504 may be any suitable conduits, such as copper and/or aluminum tubing. The four-way valve 111 may be any known four-way valve, such as a reversing valve widely used in PTAC units. The four-way valve 111 may also include a solenoid controlled pilot valve that shifts a shuttle within the four-way valve. The operation and construction of such four-way valves is well known and not described in detail herein.

With such a dehumidification mode, in some embodiments, an inverter compressor 110 and/or an inverter may be provided to create a variable speed system that can run in a low speed dehumidification mode. In such embodiments, the compressor 110 may be operated at various speeds depending on the current air conditioning needs of the room and the demands of the refrigeration loop 500. For example, the compressor 110 may be configured to operate at any speed between a minimum speed, e.g., 1500 revolutions per minute (RPM), to a maximum speed, e.g., 3500 RPM. Notably, use of variable speed compressor 110 enables efficient operation of the refrigeration loop 500 (and thus air conditioning unit 100) in the low-speed dehumidification mode, minimizes unnecessary noise when compressor 100 does not need to operate at full speed, and ensures a comfortable environment within the conditioned room.

In some embodiments, the operation of the air conditioning unit 100 and/or other suitable components (e.g., the compressor 110, indoor fan 104, outdoor fan 108, etc.) may be controlled by a processing device such as a controller 134 in communication (via, for example, a suitable wired or wireless connection) to such components of the air conditioning unit 100. The controller 134 may include a memory and one or more processing devices such as microprocessors, CPUs or the like, such as general or special purpose microprocessors operable to execute programming instructions or micro-control code associated with operation of unit 100. The memory may represent random access memory such as DRAM, or read only memory such as ROM or FLASH. In some embodiments, the processor executes programming instructions stored in memory. The memory may be a separate component from the processor or may be included onboard within the processor. Additional on-board memory may also be incorporated into the control system containing instructions for implementing the various features and functions noted herein. In some embodiments, the controller 134 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

In some embodiments, the controller 134 may be located proximate a control panel 136 at the top of the air conditioning unit 100 as shown in FIG. 1. The control panel 136 may include one or more user inputs, such as buttons, switches and/or dials. The user inputs may be in communication with the controller 134. A user may interact with the control panel 136 to operate the air conditioning unit 100, and user commands may be transmitted between the user inputs and the controller 134 to facilitate operation of the air conditioning unit 100 based on such user commands. In some embodiments, a display may be provided on the control panel 136, and may be in communication with the controller 134. The display may, for example be a touch-screen or other text-readable display screen, or alternatively may simply be a light that can be activated and deactivated as required to provide an indication of, for example, an event or setting for the air conditioning unit 100. Additionally, the air conditioning unit 100 may be controlled by a variety control mechanisms, including but not limited to, remotely mounted thermostatic controllers, handheld remote controllers, such as smart phones or other smart devices.

In some embodiments, the controller 134 may be configured to operate the makeup air fan 202, so the makeup air fan 202 may be constantly active when the air conditioning unit 100 is running. Such constant operation of the makeup air fan 202 may facilitate the constant supply of makeup air into the indoor portion 112 and thus into the conditioned room in which the unit 100 is installed. In some embodiments, the indoor fan 104, the outdoor fan 108, and the makeup air fan 202 may be all electrically connected to the controller 134, so the fan speed (e.g., high, medium, low) may be adjusted by a user through the control panel 136, for example, by turning a control knob.

In some embodiments, the air conditioning unit 100 may further include a temperature sensor and/or a humidity sensor. The temperature sensor and the humidity sensor may, for example, be disposed within the conditioned room, and may be configured to measure the room temperature and relative humidity respectively. Any suitable temperature sensor and humidity sensor may be utilized in accordance with the present disclosure. As discussed herein, the temperature sensor and the humidity sensor may be in communication with the various components of the air conditioning unit 100, such as through the controller 134, and utilized to control operation of the air conditioning unit 100. In some embodiments, the controller 134 may selectively activate the air conditioning unit 100 and/or the makeup air system 200 in response to measurements from the temperature sensor and/or the humidity sensor. For example, when the outdoor humidity level is above a predetermined humidity threshold and/or the outdoor temperature above a predetermined temperature threshold, the controller 134 may activate the dehumidification mode. Under this mode, the controller 134 may be configured to switch the variable potion 602 of the indoor heat exchanger 102 into a condenser for reheat by controlling the electrical expansion valves 113 and 115 and/or reduce the fan speed of the inverter compressor 110. When an outdoor humidity level is below the predetermined humidity threshold and/or an outdoor temperature is below the predetermined temperature threshold, the controller 134 may further be configured to deactivate the dehumidification mode. The predetermined humidity threshold may be between approximately 30% and approximately 70% relative humidity, such as approximately 60% relative humidity. The predetermined temperature threshold may be between approximately 50° F. and approximately 90° F., such as approximately 70° F.

In some embodiments, the controller 134 may be used to activate the makeup air system 200 at certain times of the day by presetting the controller 134. It may also be possible to automatically activate the makeup air system 200 based on the occupancy in the room. In such embodiments, an occupancy sensor may be provided in the room and connected to the controller 134 via electrical wires or wirelessly. For example, when the occupancy sensor determines there is no occupant in the room, the controller 134 may be configured to close the vent door 206 to prevent makeup air from flowing from the outdoor portion 120 into the indoor portion 116 and deactivate the makeup air fan 202. By doing this, energy efficiency is improved as all of the air being air conditioned is room return air at a closer temperature range and the makeup air fan 202 is off. Accordingly, when the occupancy sensor determines there is occupant in the room, the controller 134 may be configured to open the vent door 206 and automatically activate the makeup air fan 202 of the makeup air system 200 to provide a desired amount of makeup air to meet the requirements of related codes and regulations. In some embodiments, an oxygen sensor may be configured in a similar manner. For example, when the oxygen sensor determines that the oxygen level drops below a preset value, the controller 134 may be configured to open the vent door 206 and automatically activate the makeup air fan 202 to draw fresh makeup air into the room.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. An air conditioning unit, comprising:

an outdoor heat exchanger disposed in an outdoor portion;

an indoor heat exchanger disposed in an indoor portion;

a partition plate disposed between said outdoor heat exchanger and said indoor heat exchanger along a transverse direction, said partition plate defining an indoor portion and an outdoor portion;

a bottom plate wherein components of the air conditioning unit are disposed thereon; and a makeup air system comprising a makeup air duct having a first end and a second end, wherein said makeup air duct includes a top wall and first and second sidewalls that define a makeup air flow passage in fluid communication between said first end and said second end to allow makeup air to flow therethrough, wherein said makeup air duct is a separate structure built in said bottom plate, wherein said first and second sidewalls are respectively disposed inwardly of first and second sides of said bottom plate, and wherein at least one of the first and second ends of the makeup air duct extends into at least one of the indoor and outdoor portions beyond a surface of the partition plate.

2. The air conditioning unit of claim 1, further comprising an indoor fan configured to direct air flow through said indoor heat exchanger and into a conditioned room and an outdoor fan configured to direct air flow through said outdoor heat exchanger, wherein said makeup air system further comprises a makeup air fan in said outdoor portion and separate from said indoor fan and said outdoor fan to supply makeup air to said makeup air duct.

3. The air conditioning unit of claim 1, wherein said makeup air system further comprises a vent door in said outdoor portion to open and close said makeup air flow passage to said makeup air duct.

4. The air conditioning unit of claim 3, wherein said vent door is configured to switch between a first, open position and a second, closed position.

5. The air conditioning unit of claim 1, wherein said makeup air system further comprises a filter located in said outdoor portion.

6. The air conditioning unit of claim 5, wherein said filter is a MERV 13 filter.

7. The air conditioning unit of claim 1, wherein said first end is positioned in said outdoor portion and is adjacent said partition plate, with said second end positioned in said indoor portion.

8. The air conditioning unit of claim 1, wherein said second end is configured to direct makeup air into a conditioned room directly and without mixing with conditioned room return air within said indoor portion.

9. The air conditioning unit of claim 1, wherein said second end is configured to direct makeup air into said indoor portion.

10. The air conditioning unit of claim 4, further comprising a controller and a room occupancy sensor, wherein said controller is configured to open and close said vent door based on a signal from said room occupancy sensor.

11. An air conditioning unit, comprising:

an outdoor heat exchanger disposed in an outdoor portion;

an indoor heat exchanger disposed in an indoor portion;

a partition plate disposed between said outdoor heat exchanger and said indoor heat exchanger along a transverse direction, said partition plate defining an indoor portion and an outdoor portion and having a bottom edge;

a bottom plate wherein components of the air conditioning unit are disposed thereon; and a makeup air system comprising a makeup air duct having a first end and a second end, wherein said makeup air duct includes a top wall and first and second sidewalls that define an air flow passage in fluid communication between said first end and said second end to allow makeup air to flow therethrough, wherein said makeup air duct is a separate structure underneath said bottom edge of said partition plate, and wherein said first and second sidewalls are respectively disposed inwardly of first and second sides of said bottom plate.

12. The air conditioning unit of claim 11, wherein said second end is configured to direct makeup air into a conditioned room directly and without mixing with conditioned room return air within said indoor portion.

13. The air conditioning unit of claim 11, wherein said second end is configured to direct makeup air into said indoor portion.

14. A makeup air system for an air conditioning unit having a bottom plate accommodating components of the air conditioning unit and a partition plate defining an outdoor portion and an indoor portion, comprising:

a makeup air duct having a first end and a second end, wherein said makeup air duct includes a top wall and first and second sidewalls that define a makeup air flow passage in fluid communication between said first end and said second end to allow makeup air to flow therethrough, wherein said makeup air duct is a separate structure built in said bottom plate, wherein said first and second sidewalls are respectively disposed inwardly of first and second sides of said bottom plate, and wherein said second end is configured to direct makeup air into a conditioned room directly and without mixing with conditioned room return air within said indoor portion.

15. The makeup air system of claim 14, wherein said makeup air system further comprises a makeup air fan in said outdoor portion and separate from an indoor fan that directs air flow through an indoor heat exchanger of the air conditioning unit and an outdoor fan that directs air flow through an outdoor heat exchanger of the air conditioning unit to supply makeup air to said makeup air duct.

16. The makeup air system of claim 14, further comprising a vent door located in said outdoor portion.

17. The makeup air system of claim 14, further comprising a filter located in said in said outdoor portion.

18. The makeup air system of claim 14, wherein said first end is positioned in said outdoor portion and is adjacent said partition plate, with said second end positioned in said indoor portion.

19. The makeup air system of claim 14, wherein said second end is configured to direct makeup air into said indoor portion.

* * * * *